US007238253B2

(12) United States Patent
Ward, Jr. et al.

(10) Patent No.: US 7,238,253 B2
(45) Date of Patent: Jul. 3, 2007

(54) BAG MANUFACTURING SYSTEM

(75) Inventors: N. Robert Ward, Jr., Woodinville, WA (US); Geoffrey S. Bright, Bothell, WA (US)

(73) Assignee: Biotrace International Bioproducts, Inc., Bothell, WA (US)

( * ) Notice: Subject to any disclaimer, the term of this patent is extended or adjusted under 35 U.S.C. 154(b) by 0 days.

(21) Appl. No.: 10/847,649

(22) Filed: May 17, 2004

(65) Prior Publication Data

US 2005/0028924 A1 Feb. 10, 2005

Related U.S. Application Data

(60) Provisional application No. 60/471,093, filed on May 15, 2003.

(51) Int. Cl.
*B65D 33/30* (2006.01)

(52) U.S. Cl. ..... 156/265; 156/302; 156/355; 156/522; 156/555; 156/566; 156/570; 156/582; 493/212; 493/264; 493/267; 383/35; 383/91

(58) Field of Classification Search ..... 493/212, 493/214, 345, 380; 383/203, 204, 205, 207, 383/209, 85, 35, 91; 156/522, 302, 265, 156/566, 570, 355; 271/12; 53/450
See application file for complete search history.

(56) References Cited

U.S. PATENT DOCUMENTS

| | | | | |
|---|---|---|---|---|
| 2,973,131 | A | 2/1961 | Mead et al. | |
| 3,189,253 | A | 6/1965 | Mojonnier | |
| 3,315,877 | A * | 4/1967 | Grevich | 383/91 |
| 3,612,111 | A * | 10/1971 | Meyer | 140/1 |
| 4,210,320 | A * | 7/1980 | Feldkamper | 271/108 |
| 4,356,954 | A | 11/1982 | Mojonnier | |
| 4,420,295 | A * | 12/1983 | Clear et al. | 425/92 |
| 4,515,273 | A * | 5/1985 | Jacobson et al. | 383/205 |
| 4,863,544 | A * | 9/1989 | Plate et al. | 156/251 |
| 5,180,220 | A | 1/1993 | Van Kalsbeek | |
| 5,180,229 | A | 1/1993 | Niemeyer | |
| 6,136,142 | A * | 10/2000 | Kitagawa et al. | 156/555 |
| 6,585,413 | B1 * | 7/2003 | Ward et al. | 383/35 |
| 2004/0011452 | A1 * | 1/2004 | Capodieci | 156/73.3 |

OTHER PUBLICATIONS

"Pick and Place" (4 pp.), MGS Machine Corporation, 1987.
"Model 230 Label Applicator" (2 pp.), Accraply, Inc., publication date unknown.
"2000H Series" (2 pp.), Bedford Technology, 1994.
"Reclosable Packaging Systems" (2 pp.), Bedford Technology, 1996.

(Continued)

*Primary Examiner*—Linda Gray
(74) *Attorney, Agent, or Firm*—Christensen O'Connor Johnson Kindness PLLC

(57) ABSTRACT

A placement component rapidly moves individual bag blanks from a pack or magazine to a conveyor system in uniformly spaced relationship. Each bag blank has opposite surfaces. While the conveyor system continues to move the bags, opening tabs are automatically applied to opposite surfaces of each bag, followed by high speed application and cutting of sideways extending flexible closure strips. The bag blanks are moved continuously from the placement component to the high speed cutting section, as compared to incremental movement, for high speed manufacturing of specialized bags.

7 Claims, 12 Drawing Sheets

OTHER PUBLICATIONS

"Bag Tin-Tie Applicator" (2 pp.), Bedford Technology, 1998.
"Team Designed" (4 pp.), Bedford Technology, 1997.
"2200 Series" (2 pp.), Bedford Technology, 1999.
"Series 3000V Applicators" (2 pp.), Nordson Corporation, 2000.

* cited by examiner

BAG MANUFACTURING SYSTEM

CROSS-REFERENCE TO RELATED APPLICATION

This application claims the benefit of U.S. Provisional Application No. 60/471,093, filed May 15, 2003.

FIELD OF THE INVENTION

This invention relates to a system for making a special receptacle or package, and more particularly to a system for making a reclosable sterile collection bag having a flexible strip closure mechanism.

BACKGROUND OF THE INVENTION

Bags having wire closure mechanisms are currently used to obtain industrial, chemical, and forensic material samples in a sterile manner. For example, U.S. Pat. No. 2,973,131 describes a collection bag having metal wires. Strips of pressure sensitive tape are used to attach the metal wires to opposite sides of the bag. Both the wires and the tape project beyond the side edges of the bag. During use, the bag is filled, the mouth of the bag is closed and rolled against the body of the bag, and the projecting portions of the metal wires are folded back to clamp the rolled end closed.

Later inventions have been made to improve the ease with which the bag may be opened. For example, U.S. Pat. Nos. 3,189,253; 4,356,954; and 5,180,220 each use center pull tabs. U.S. Pat. No. 4,356,954 uses downwardly-directed strip ends. U.S. Pat. No. 5,180,229 encloses the wire ends with an additional length of covering material. The arrangements of the above patents can be difficult and costly to manufacture. Other potential problems are pull tabs or tear strips that become separated from their bags and fall into (and therefore contaminate) foodstuffs or other products, and bags that are difficult to open or which may be punctured inadvertently.

SUMMARY OF THE INVENTION

The present invention provides a novel system for manufacturing a sterile collection bag having a body and an opening mechanism. The body is formed of opposed sidewalls and includes an upper body end portion adjacent to the mouth opening. The interior of the body defines a sterile collection space for a sample object or fluid. The opening mechanism includes first and second flexible closure strips, each having a first end, a second end, and a midsection. The strips can be constructed of plastic with an integrated, centrally located metal wire. The strips are attached to the sidewalls of the bag body and are longer than the width of the body so as to project beyond the sidewall edges. The projecting ends of the strips can be secured to one another.

The bag can be designed in such a way as to prevent the intrusion of air and other contaminants to the interior sterile collection space until its initial use, by sealing the top of the bag. For example, the bag can be formed of polymer film, and one or more lateral notches are cut slightly above the location of the attached flexible closure strips. The strips can be sufficiently rigid and abrupt to facilitate lateral tearing of the upper end of the bag, guided by an adjacent edge of a closure strip. This allows the top of the bag to be torn away for opening upon initial use, but prevents air and other contaminants from entering the interior sterile collection space beforehand.

In accordance with the present invention, bags of the type described above can be manufactured inexpensively and at high speed by automatic equipment including a placement component for rapidly moving individual bag blanks from a pack or magazine to a conveyor system in uniformly spaced relationship, and automatic equipment for applying opening tabs to opposite surfaces of the bag, followed by high speed application and cutting of the flexible closure strips. The manufacturing method preferably is conducted with the bag blanks moved continuously from the placement section to the high speed cutting section, as compared to incremental movement which could slow down the manufacturing process.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a system for manufacturing a bag that can be used in collection, processing, and manipulation of material samples taken for biological, industrial (such as food sampling) and forensic testing.

Figure 1:
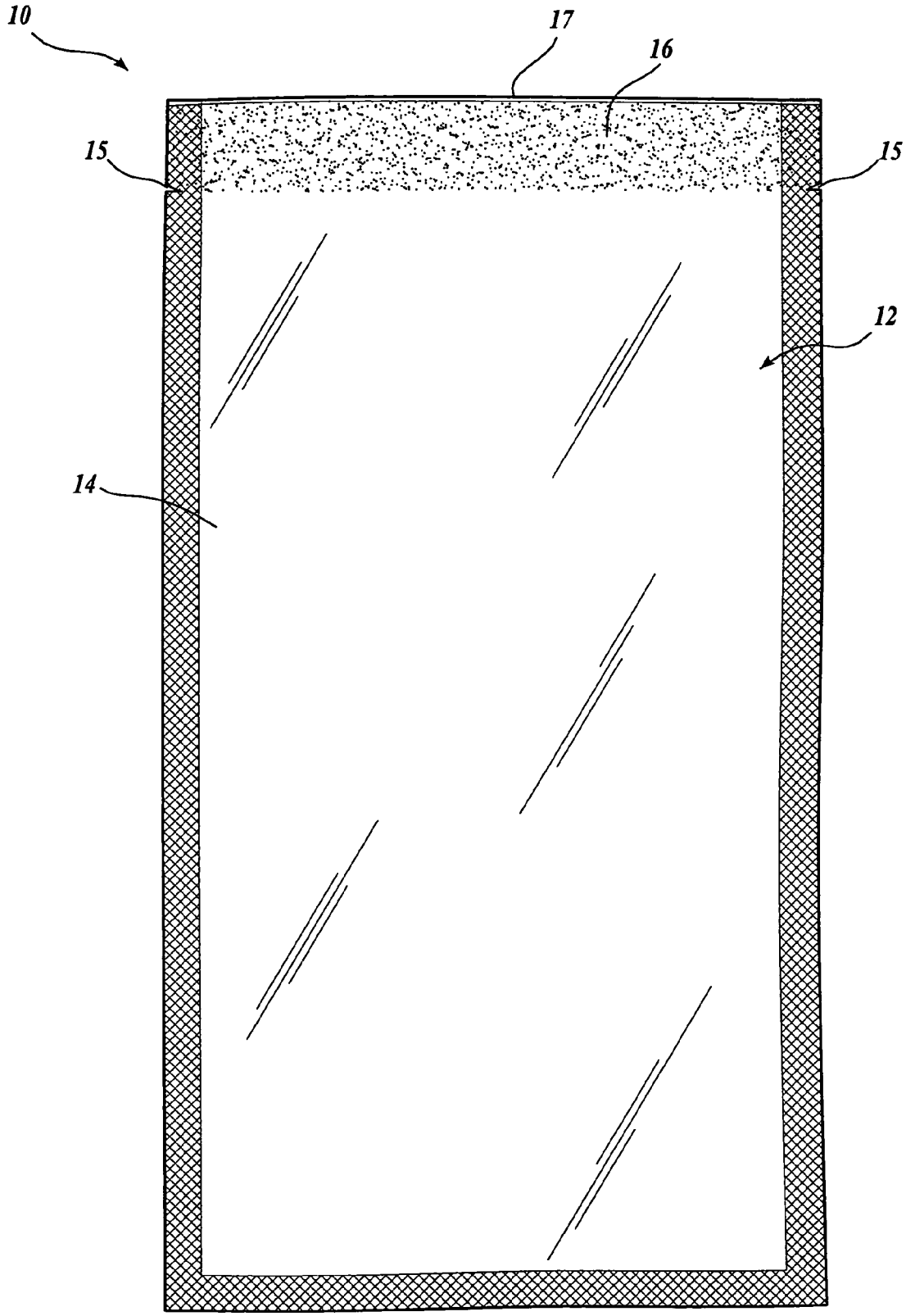
FIG. 1 is a front elevation of a sterile collection bag that can be made by the system of the present invention.

Referring to FIG. 1, the bag 10 includes a body 12 formed of plastic or other known flexible, non-porous collection bag material. The body 12 includes opposed front and rear walls 14 and an upper body end portion 16. Each sidewall 14 has an exterior surface and a center section. The bottom and side edges of the sidewalls are sealed, such as by conventional heat sealing or adhesive, represented by the cross-hatching along the bottom and side marginal portions. The top edge 17 also is sealed. The interior of the body 12 defines a sterile collection space for a sample to be placed. Notches 15 are provided at the side edges of the sidewalls 14 at the juncture between the bag body 12 and upper body end portion 16. Preferably the upper body end portion 16 is brightly colored or otherwise prominently marked (represented by stippling in the drawings) so as to be readily visible when separated from the remainder of the bag structure as described below.

Figure 2:
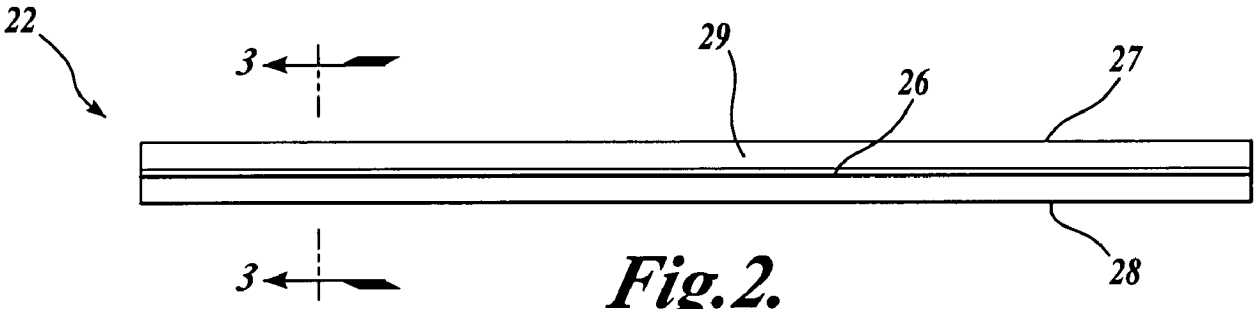
FIG. 2 is a front elevation of a closure strip for use with the bag of FIG. 1.
Figure 3:
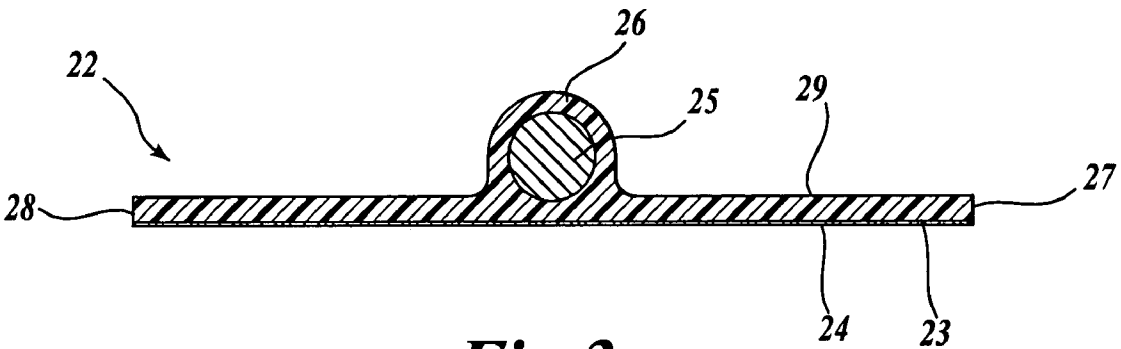
FIG. 3 is an enlarged section along line 3—3 of FIG. 2.

A flexible closure strip 22 usable with the bag of FIG. 1 is illustrated in FIGS. 2 and 3. With reference to FIG. 3, closure strip 22 has an essentially planar backside 23 which may be coated with a layer of adhesive 24. A malleable wire 25 is embedded in a longitudinally extending rib 26 which preferably is located intermediate the top and bottom edges 27, 28 of the strip. Thus, a substantial protrusion is provided on the front side 29 of strip 22. Preferably the wire 25 is entirely surrounded and coated by the plastic material of the strip, so that no part of the midsection of the wire is exposed. The plane of the front side 29 of the strip, ignoring the rib 26, is approximately aligned with the periphery of the embedded wire 25.

The wire is a malleable metal, similar to wires used for common twist ties. In this construction, the plastic material also is a malleable material having little, if any, memory or spring characteristics, such that a double thickness of strips 22 can be easily bent to a new configuration and retain that configuration until bent back or bent to a new configuration. However, when in the flat configuration illustrated in FIG. 2, at least the top edge 27 of the strip has sufficient thickness so as to be almost rigid as compared to the flexible bag material, with an abrupt corner or corners.

As described in more detail below with reference to FIGS. 10–13, to facilitate bag manufacture and assembly by automatic machinery, long lengths of the closure strip 22 may be formed in rolls, prior to application of the adhesive coating 24. Strips of a desired length can be cut from the roll and applied to the bag, all by the automatic machinery, but, in accordance with the present invention, continuous strips may be applied across multiple bags before the strips are cut. The wires 25 embedded in the pre-formed strips are reliably positioned as desired at the center of the strips. This alleviates the prior problem of misalignment of wires under paper tapes, direct contact of the wires with the bags, and exposed wires.

Figure 4:
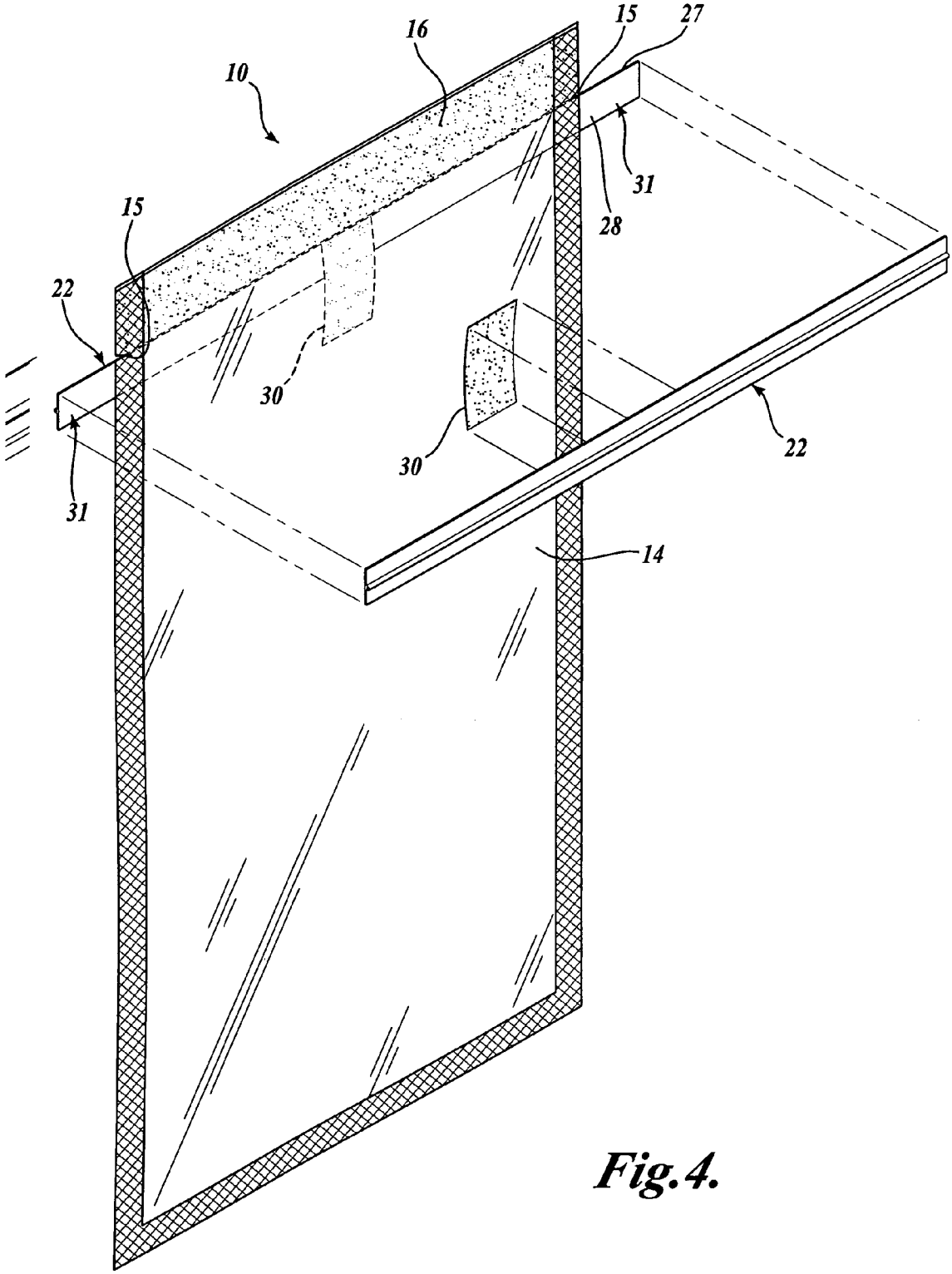
FIG. 4 is a top perspective of a bag that can be made by the system of the present invention with some component parts shown in exploded relationship.

With reference to FIG. 4, each strip 22 is applied to its bag with the top edge 27 of the strip extending between or close beneath the bag notches 15. As see in the drawings, the front and back strips are in directly opposed relationship. Preferably the manner of attachment is adhesive applied along the midsection and projecting end portions 31 of each strip. Thus such end portions are secured together at their flat rear faces 28. Opening tabs 30 have top end portions interposed between the strips 22 and the bag sidewalls 14, and secured thereto by the adhesive. Such tabs have large projecting portions which preferably are square and approximately one inch in width by one inch in length, at least about ¾ inch in each dimension in the preferred embodiment. The projecting parts of these tabs 30 hang loose and are of a textured material suitable for writing indicia on them by a conventional writing instrument such as a pen or pencil, and of non-slippery material, i.e., with a sufficiently high co-efficient of friction that they may be readily grasped between a user's thumb and forefinger, for example, and pulled relatively apart as described below with reference to FIG. 6.

Figure 5:
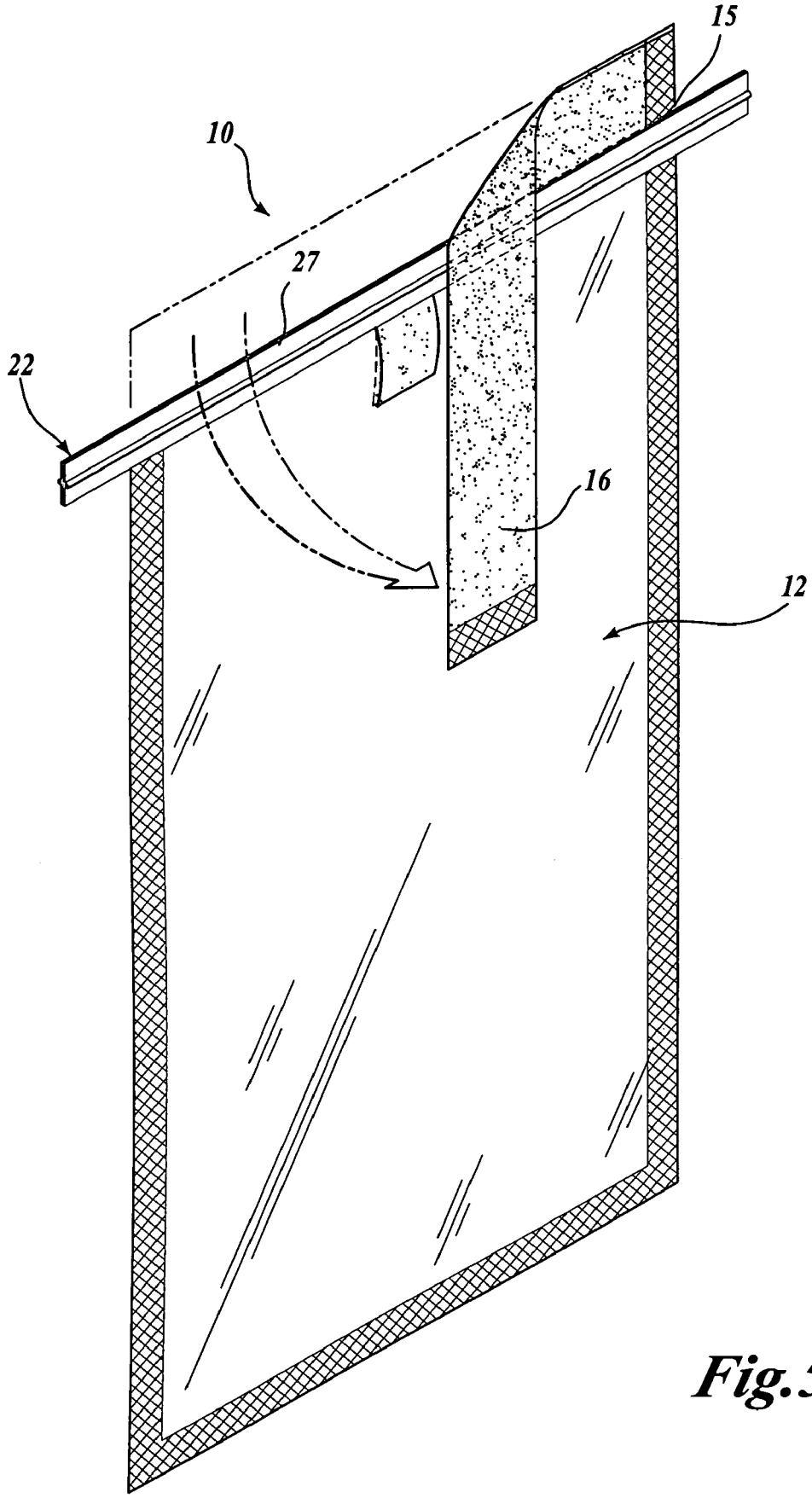
FIG. 5 is a top perspective corresponding to FIG. 4, but with the parts assembled and the bag partially opened prior to use for collection of a sample.

With reference to FIG. 5, the side notches breach the sheer strength of the plastic bag material providing a convenient starting point for a tear across the upper end portion 16 of the bag. Preferably the notches do not extend beyond the inner edge of the sealed area which would provide an opening into the interior of the bag that could cause contamination. The upper end portion is peeled downward along the top edge 27 of one or the other of the closure strips 22, as shown in FIG. 5. The sharp or abrupt top edge 27 of the strip 22 guides the tear and assists in assuring a clean, complete separation of the upper end portion 16 from the body 12 of the bag. The bag material can be a transversely oriented polymer, but an advantage of the invention is that a less expensive nonoriented polymer film can be used without scoring or partial perforation while still allowing the bag to be opened for use by tearing away the top end section 16.

Typically, the bags are formed of a transparent or nearly transparent material, for visualization of any samples held therein. However, it has been found that upper tear strips of a transparent material may fall into the nearby environment, causing possible contamination. The brightly colored or otherwise prominently marked tear strip of the present invention is readily identified so that it will be retrieved if it is inadvertently dropped.

Figure 6:
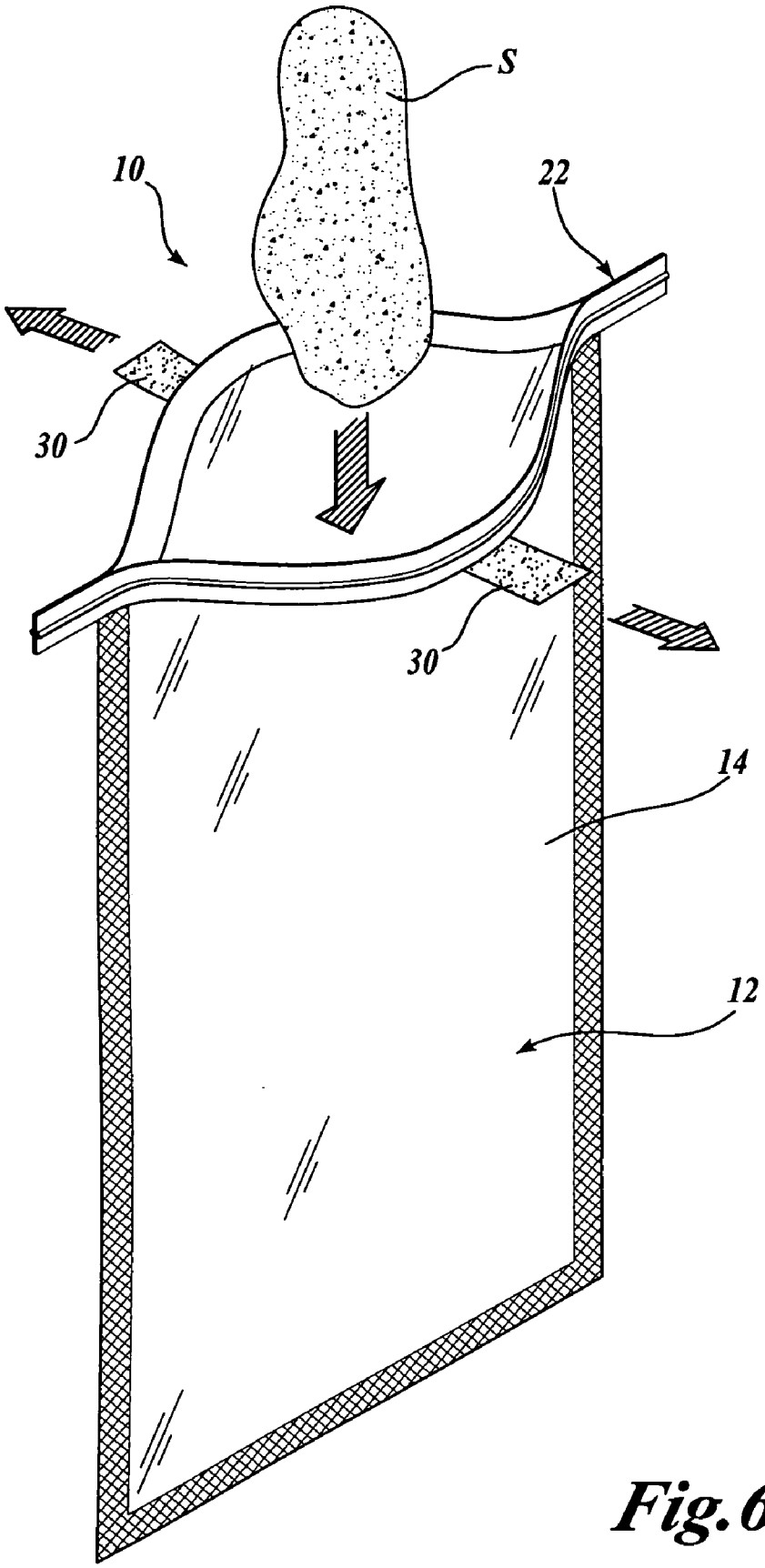
FIG. 6 is a top perspective corresponding to FIG. 5, with the mouth of the bag opened for insertion of a sample.

With reference to FIG. 6, once the upper body end 16 has been tom from the bag, the mouth of the bag can be opened conveniently by pulling on the projecting tabs 30. The desired sample S can be inserted through the open mouth of the bag. For the reasons discussed above, preferably the tabs 30 are brightly colored or otherwise prominently marked in case they become separated from the bag. Also, the non-slippery material, in combination with large tabs, make opening the bag mouth more convenient than in known designs, and the tabs provide a location for marking information concerning the contents, date of collection, etc.

Figure 7:
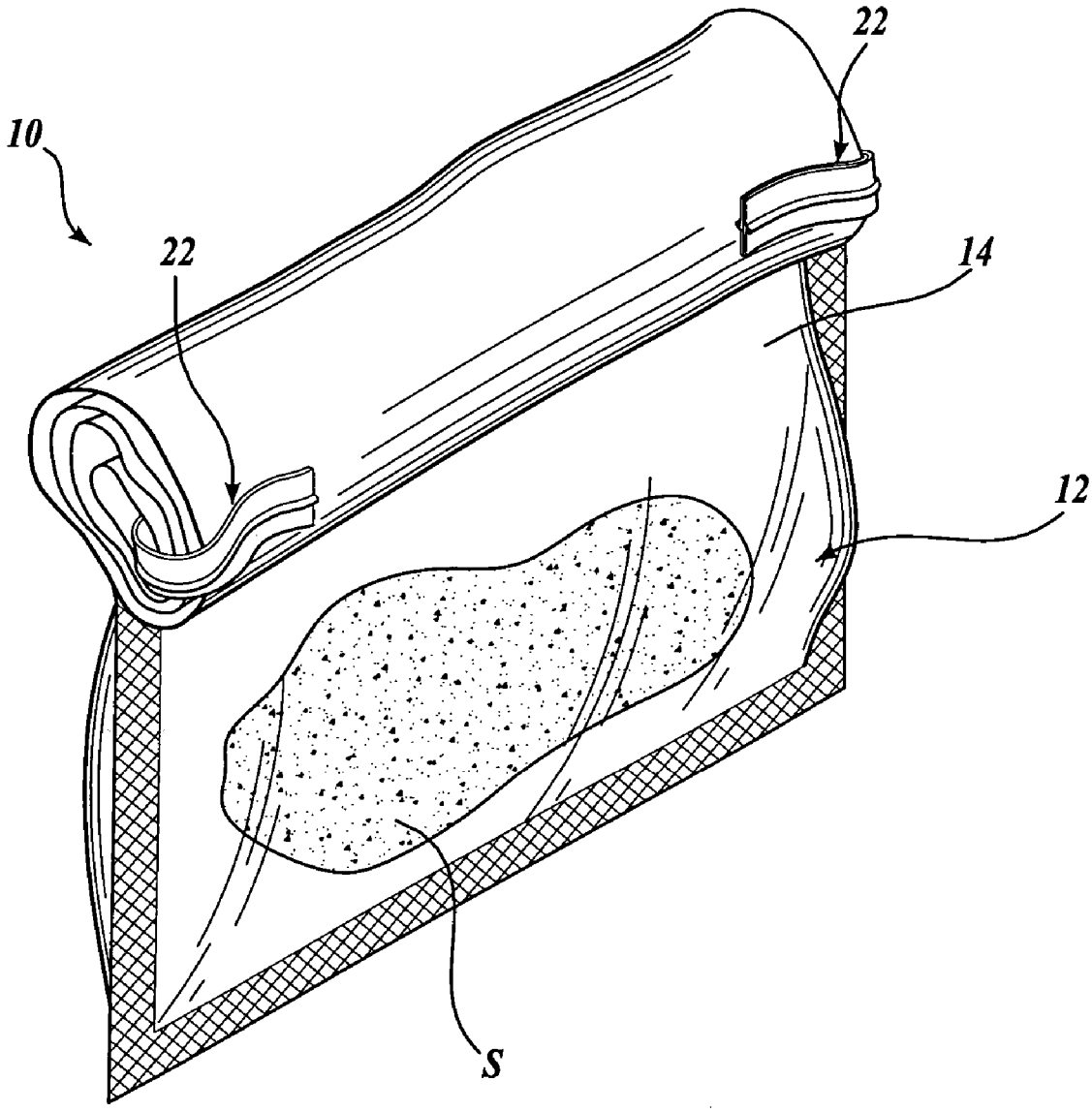
FIG. 7 is a perspective of a bag in accordance with FIG. 6 rolled and clamped closed to retain a collected sample therein.

After insertion of the sample S into the bag, the mouth is closed manually, rolled shut, and the projecting ends of the closure strips folded back onto the body of the bag to clamp it in the closed condition shown in FIG. 7.

Figure 8:
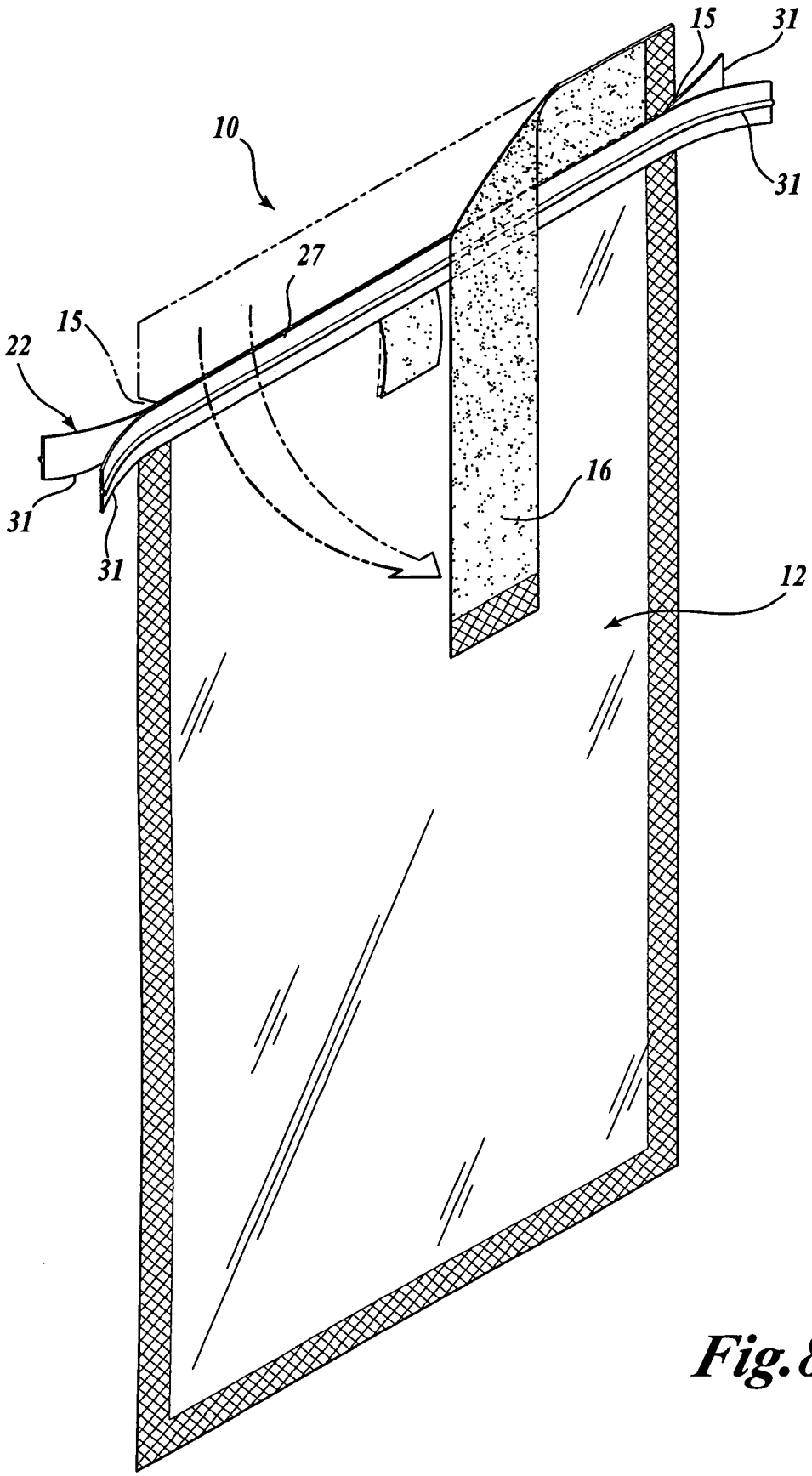
FIG. 8 is a top perspective of an alternative bag partially opened.
Figure 9:
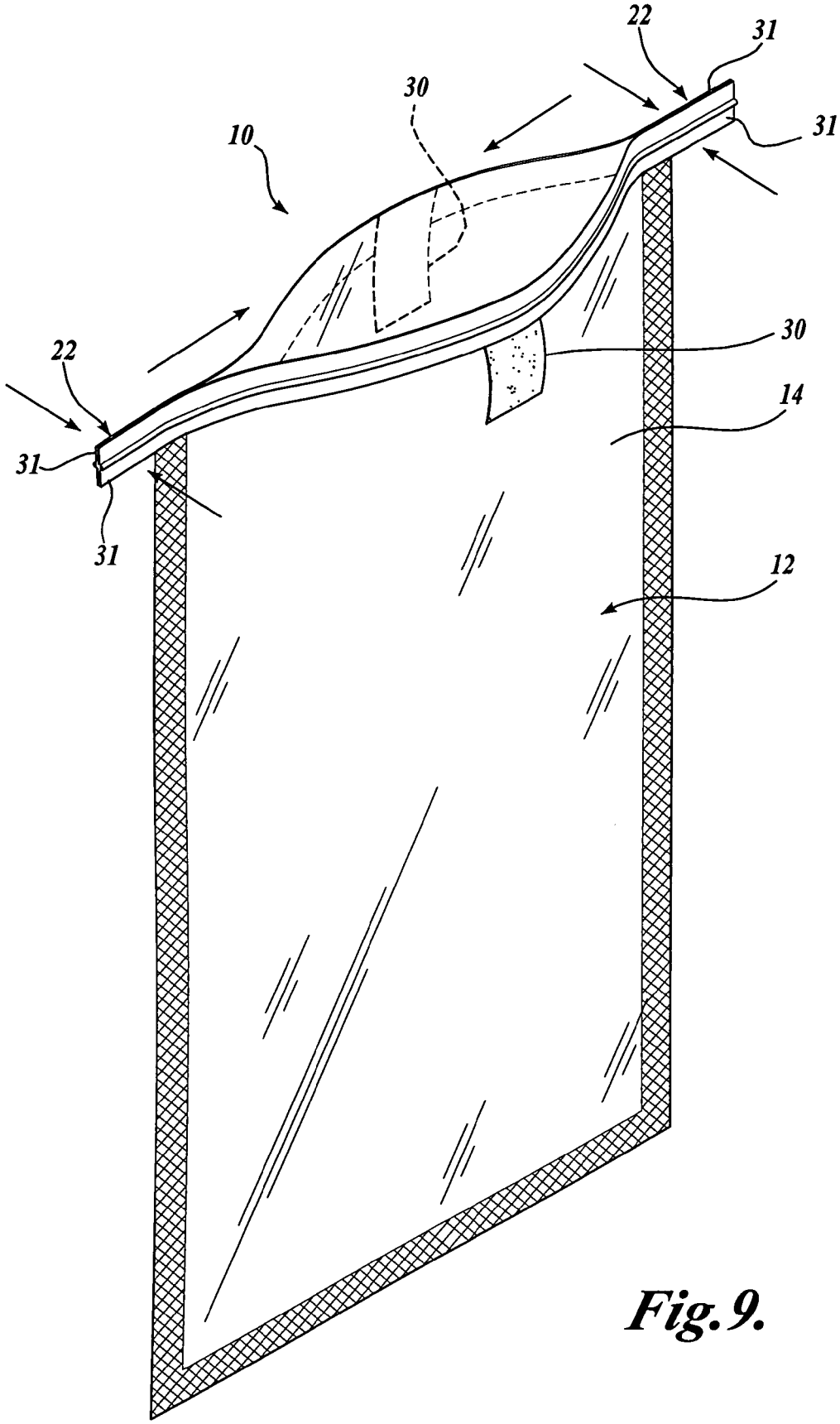
FIG. 9 is a top perspective of the alternative bag with the mouth of the bag opened.

In the construction illustrated in FIGS. 8 and 9, the projecting end portions 31 of the front and rear closure strips 22 are not secured together. The midsections of the strips, which can be less pliable than the strips of the previously described construction, are adhered to the bag body, but end portions 31 are unconnected so that they may diverge from each other at a small acute angle from the side edges of the bag to their free ends. Otherwise, the embodiment of FIGS. 8 and 9 is identical to the embodiment previously described. The top end part 16 can be torn beginning from a notch 15 along the abrupt top edge 27 of a strip 22, as shown in FIG. 8. Thereafter, the strip ends 31 can be squeezed together to bias the midsections of the strips apart as seen in FIG. 9. If necessary to achieve a desired degree of opening, the strip ends at one side can be pushed toward the strip ends at the other, or the opening tabs can be used. After insertion of the sample, the mouth of the bag is closed, rolled, and clamped to the condition of FIG. 7.

The ends of the strips 22 can extend straight and perpendicular to the top and bottom strip edges 27, 28 as seen in FIG. 2, for example. The plastic material has less tendency to puncture a bag, and the embedded wire is not exposed to a position where it substantially increases the prospects of a puncture.

Figure 2A:
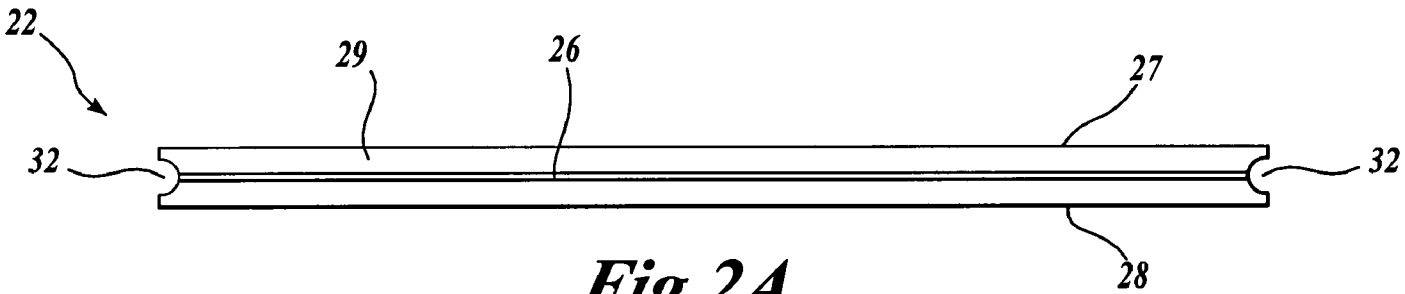
FIG. 2A is a front elevation corresponding to FIG. 2, showing an alternative closure strip that may be used.

In another construction, shown in FIG. 2A, the ends of strips 22 are formed with shallow recesses or central indentations 32 such that the wire ends are offset inward from the plastic strip ends 34. The plastic ends are broader and more blunt than the wires, and less likely to cause unintended punctures.

Figure 10:
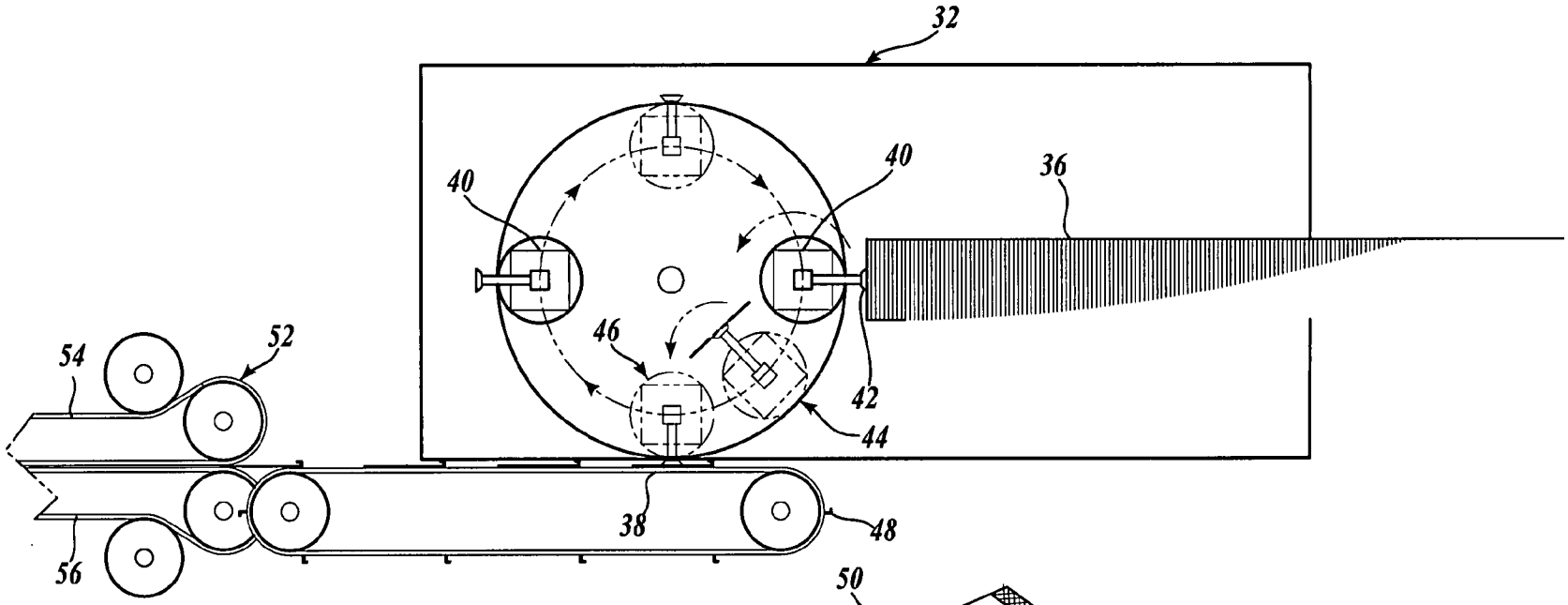
FIG. 10 is a diagrammatic side elevation of a pick-up and placement component used in a bag manufacturing system in accordance with the present invention.
Figure 10A:
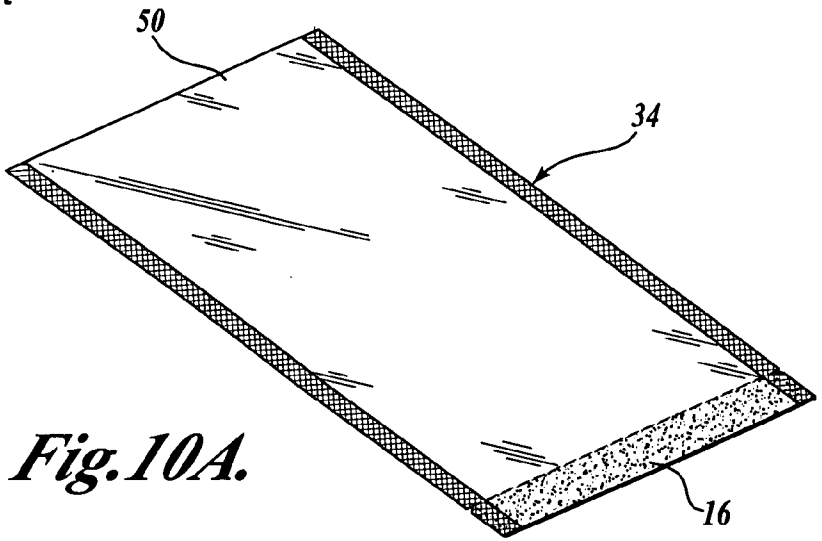
FIG. 10A is a top perspective of a bag blank operated on by such component.

FIGS. 10–13 illustrate automatic manufacture of sterile collection bags of the type described above. A placement component 32 picks up individual bag blanks 34 from a pack or magazine 36 and transfers the bags to a conveyor 38. In a representative embodiment, this component can correspond to the model RPP-421 "pick and place" equipment of MGS Machine Corporation of Maple Grove, Minn., but other conventional "pick and place" machines can be used. The RPP-421 equipment includes a planetary drive for multiple pick-up heads 40 which include pressure-actuated pick-up members 42. The pick-up members follow an epicyclic path from the pick-up point at the right of FIG. 10 through the position indicated at 44 to the position indicated at 46 where an individual bag blank is released onto the conveyor 38. Pick-up and release of the blanks is timed and coordinated so that the spacing between adjacent bags is uniform. The conveyor 38 can have projections 48 which assist in providing the desired spacing, in combination with the timed release of a bag on the upper surface of the conveyor in synchronism with the conveyor drive. An individual bag blank 34 is shown in FIG. 10A, including the upper end portion 16 which is sealed, and the sealed side marginal portions. The bottom 50 of the bag blank is open in the illustrated embodiment, so that a desired sample, reagent, dilutent, etc. can be inserted after the bag manufacturing process described herein. For sample collection, the bottom 50 of the bag blank can be sealed from the outset.

Figure 11A:
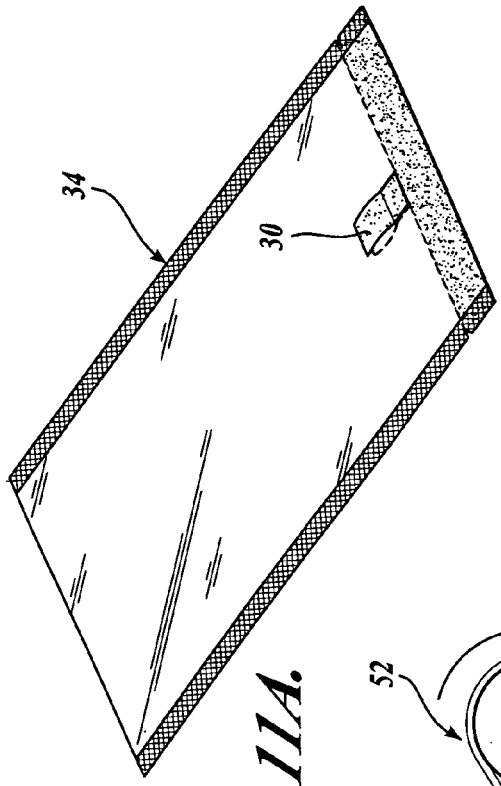
FIG. 11A is a top perspective of a bag blank operated on by such component.
Figure 11:
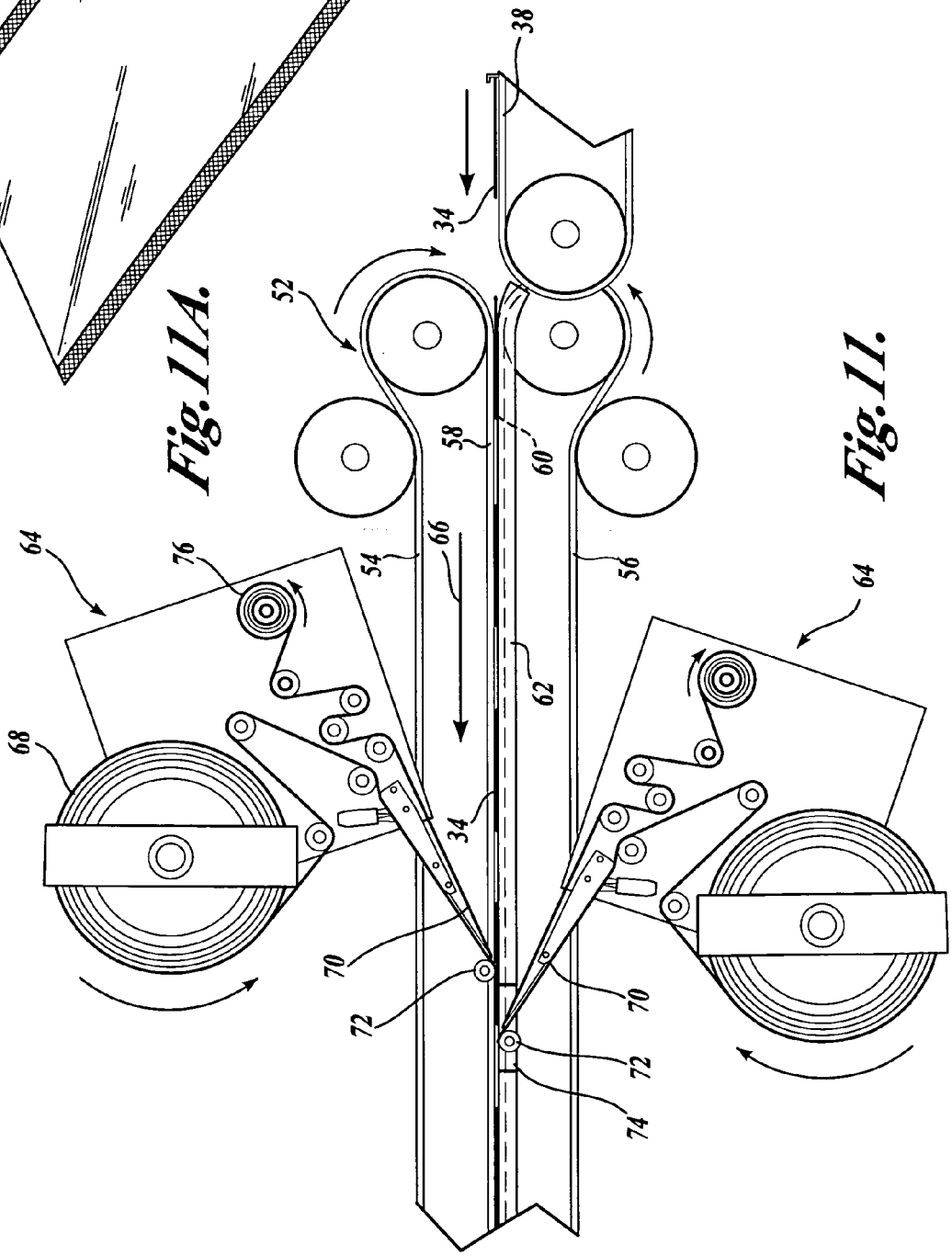
FIG. 11 is a diagrammatic side elevation of a tab-applying component used in a bag manufacturing system in accordance with the present invention.

From the constant speed, driven conveyor 38, the bags are fed to another constant speed conveying mechanism 52 which includes upper and lower endless belts 54 and 56. With reference to FIG. 11, the upper belt 54 has a lower run 58 biased relatively toward the upper run 60 of the lower belt 56. These two belts are positioned to grasp the bag blanks 34 at approximately their center portions, and slide the upper end portions of the blanks along a horizontal support and guide plate 62. This plate is offset toward the viewer in FIG. 11 from the adjacent runs 58, 60 of the belts 54, 56, but underlies the upper portions of the bag blanks. The opening tabs 30 (FIG. 11A) are applied by automatic equipment 64 as the bags are moved continuously in the direction of the arrow 66. The equipment 64 is in the form of automatic label applicators such as the model 230 applicator of Accraply, Inc., of Plymouth, Minn. The tabs are provided on a backing roll 68 with only the end portions corresponding to the upper end portions of the tabs 30 having pressure sensitive adhesive. The backing strip is wound around feed and tension rollers to an applicator head 70 and applicator roll 72. The applicator has an automatic product speed following feature such that a tab 30 is applied midway between the opposite side edges of each bag blank 34. The first tab is applied by a first applicator unit at the top, where the upper end portion of the bag is supported on the plate 62. The other tab is applied to the bottom surface by a second applicator component 64 which is offset downstream from the first unit and has its applicator head 70 and roller 72 aligned with an opening 74 through the plate 62 so that the bottom surface of the bag blank is exposed for a short distance. Following application of the tabs by the label applicators, the bare backing tape is wound on a take-up roll 76. The condition of the bag following this procedure is illustrated in FIG. 11A, with the opening tabs 30 adhesively secured to the opposite walls of the bag, but only at the top end portions, leaving a free or hanging end portion of each tab.

Figure 12A:
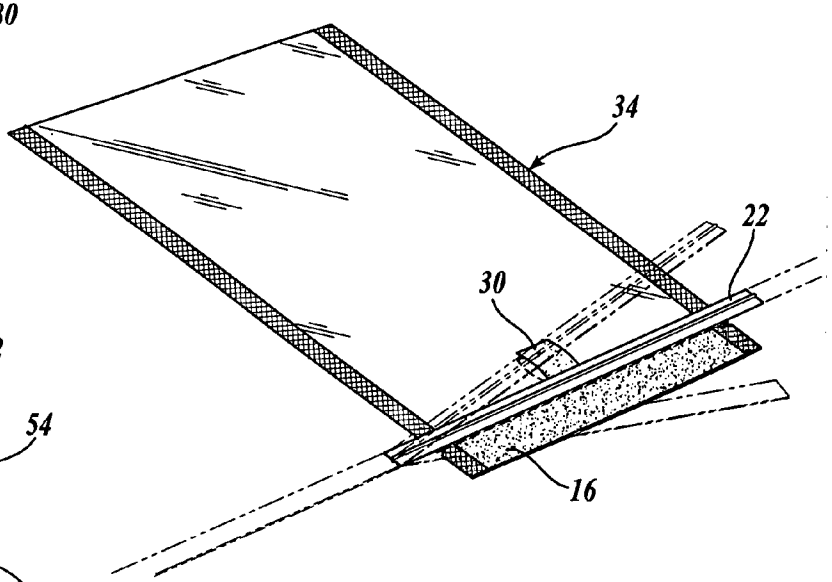
FIG. 12A is a top perspective of a bag blank operated on by such component.
Figure 12:
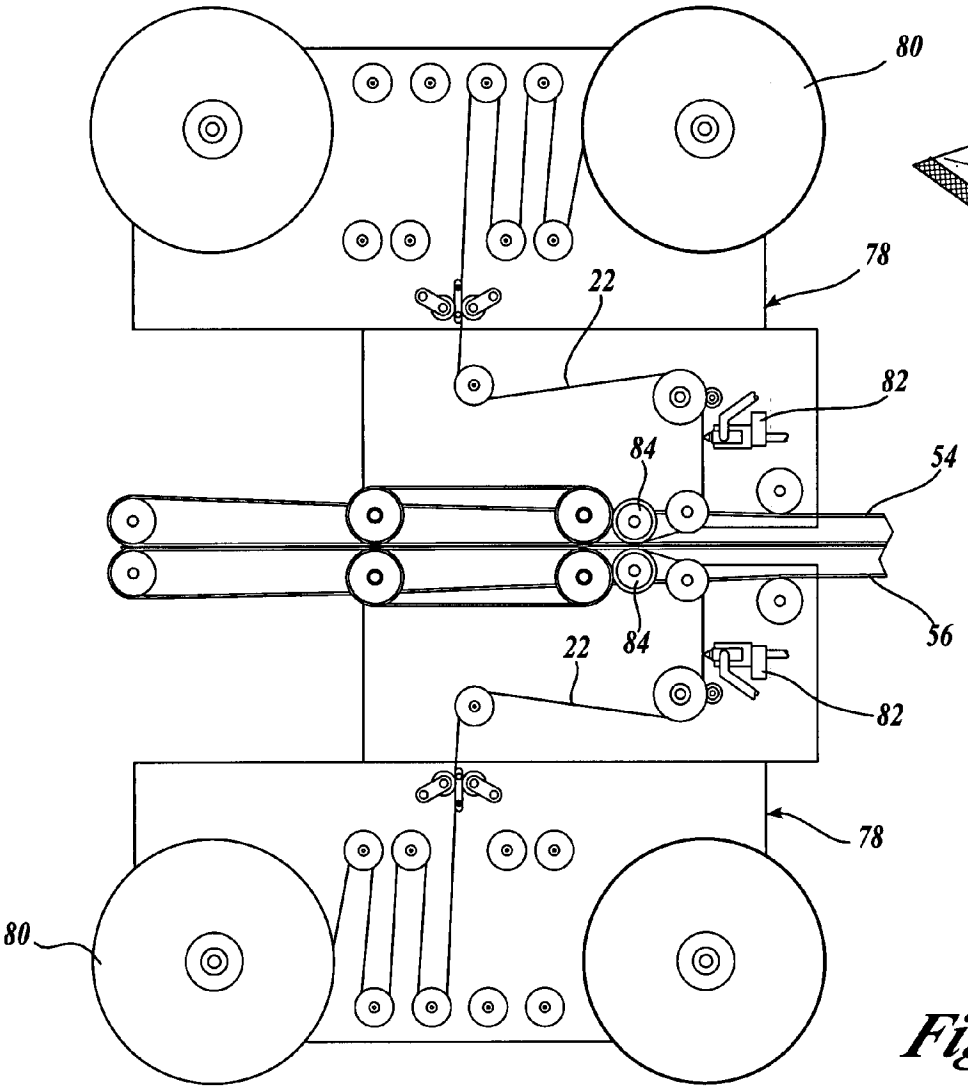
FIG. 12 is a diagrammatic side elevation of a closure strip-applying component used in a bag manufacturing system in accordance with the present invention.

With reference to FIGS. 12 and 12A, following automatic application of the oppositely located tabs, the belts 54, 56 convey the bag blanks to components 78 for applying the flexible closure strips 22. As noted above, long lengths of the closure strip material can be formed in rolls 80 with a continuous strip 22 guided past an adhesive applying nozzle 82. Each of the units 78 correspond to a "tin tie" applicator available from Bedford Technology Division of Bedford Industries of Worthington, Minn., in combination with a series 3000V hot melt adhesive applicator available from Nordson Corporation of Duluth, Ga. At the top and at the bottom, a continuous strip 22 having the cross-sectional structure shown in FIG. 3 is routed around feed and tension rollers with the flat back of the strip 22 passing adjacent to one of the nozzles 82 where a continuous bead of adhesive is applied. From the nozzles, the strips 22 are brought together between pinch rolls 84. This secures the top and bottom strips together at locations between the spaced bags being conveyed past the pinch rolls, and secures the strips to the bags in directly opposed relationship, as illustrated in FIG. 12A, for example, over the upper portions of the tabs 30 and along the upper end portions 16 of each bag blank 34.

Figure 13:
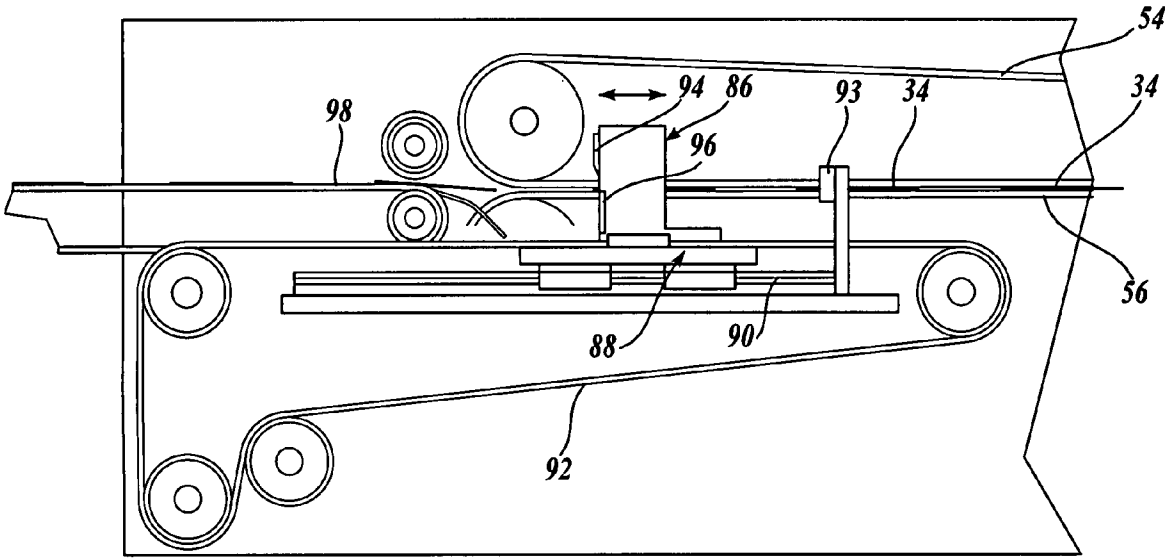
FIG. 13 is a diagrammatic side elevation of a high speed cutting component used in a bag manufacturing system in accordance with the present invention.
Figure 13A:
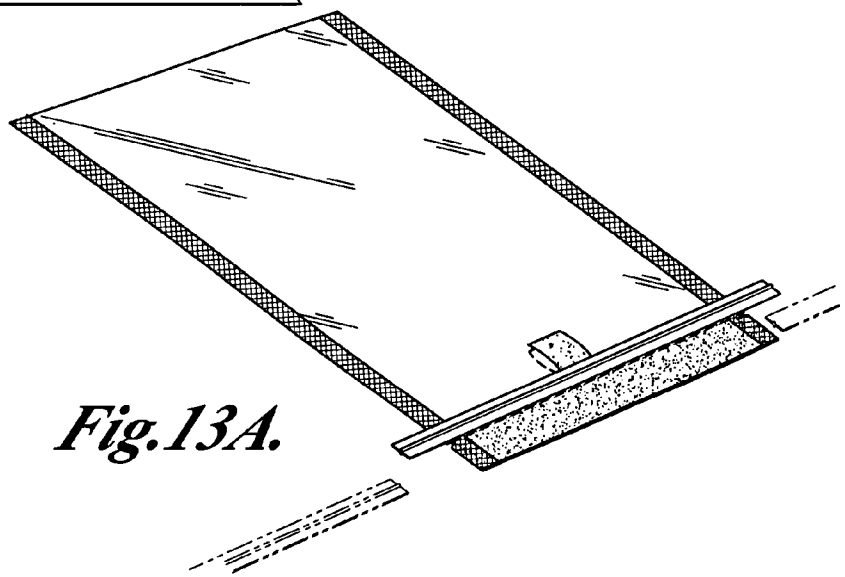
FIG. 13A is a top perspective of a bag operated on by such component.

With reference to FIGS. 13 and 13A, following application of the continuous closure strip material, the bags 34 continue their travel by the center belts 54, 56 to a high speed cutting mechanism 86. The cutting mechanism quickly and precisely cuts the strips 22 midway between adjacent bags, resulting in the bag shown in FIG. 13A. In a representative embodiment, the high speed cutting mechanism includes a carriage 88 mounted on a rail 90 for movement back and forth in the direction of and contrary to the direction of travel of the bags 34. Movement of the carriage is accomplished by a driven belt mechanism 92. A knife 94 cooperates with an anvil 96 mounted on the carriage, and is actuated as the carriage is moved at the same speed as the bags and closure strips. More specifically, a sensor 93 detects passage of a bag 34 and actuates movement of the "flying knife" carriage in the direction of travel of the bag, with the knife and anvil positioned precisely between adjacent bags. The knife 94 is rapidly moved downward to cut the strip and back upward while moving in the same direction and at the same speed as the bags. The carriage then is quickly reciprocated back to the starting position for the next cutting operation.

After the quick and precise cutting of the closure strips 22, the bags are fed to an exit conveyor 98 or other exit or collection mechanism. From the time of placement of the bags onto the first conveyor (FIG. 10), to the final cutting operation (FIG. 13), the bags preferably move continuously without stopping for any of the bag-forming operations.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. The method of manufacturing a bag, which comprises:

(1) placing bag blanks onto a conveyor with the individual bag blanks spaced uniformly along the conveyor, each bag blank having a body formed of opposing sidewalls having top and bottom ends and side edges;

(2) automatically applying an opening tab by a tab applicator to at least one sidewall of each bag blank at a location between the top and bottom ends and between the side edges of such bag blank as such bag blank is moved continuously by the conveyor past the applicator;

(3) automatically applying two lengths of closure strips to the opposite sidewalls of the bag blanks, respectively, in directly opposed relationship and adhered to the respective sidewalls as the bags are moved continuously by the conveyor, whereby the closure strips extend sideways across a bag blank and between adjacent blanks on the conveyor;

(4) while the bag blanks with applied closure strips continue to be moved by the conveyor, automatically severing opposed closure strips at locations between adjacent bag blanks, whereby the bag blanks are separated from each other, including severing opposed and abutting closure strips at locations between adjacent bags by a cooperating knife and anvil while moving the knife and anvil at the speed of movement of the bag blanks by the conveyor, and reciprocating the knife and anvil from an upstream position to a downstream position, severing the closure strips while movement of the knife and anvil in the downstream direction, and reciprocating the knife and anvil back to the upstream position; and (5) discharging the bag blanks from the conveyor with the applied tabs and closure strips.

2. The method defined in claim 1, including in step (1) automatically placing bag blanks onto a constantly moving conveyor in uniformly spaced position by picking individual blanks from a pack and placing the individual blanks consecutively on the conveyor in timed relationship.

3. The method defined in claim 1, including in step (2) automatically applying two opening tabs to opposite sidewalls of the bag blank, respectively.

4. The method defined in claim 1, including in step (3) automatically applying the two lengths of closure strips so as to extend partly over the opening tabs.

5. The method defined in claim 1, including feeding the lengths of closure strips toward the opposite sidewalls of the bag blanks, respectively, applying adhesive to the closure strips, and bringing the closure strips together between pinch rolls to adhere the closure strips to the respective sidewalls of the bag blanks as such blanks are moved continuously by the conveyor.

6. The method defined in claim 1, including in step (4) automatically sensing approach of a bag toward the knife and anvil and automatically triggering movement of the knife and anvil in a downstream direction for severance of the closure strips based on sensing of the bag blank.

7. The method defined in claim 1, including in step (1) placing the bag blanks spaced uniformly along a portion of the conveyor, then transferring the blanks onto a second portion of the conveyor before step (2), each conveyor portion having at least one continuous belt.

* * * * *